United States Patent [19]

De Nora et al.

[11] 4,098,669

[45] Jul. 4, 1978

[54] NOVEL YTTRIUM OXIDE ELECTRODES AND THEIR USES

[75] Inventors: Vittorio De Nora, Nassau, The Bahamas; Placido M. Spaziante; Antonia Nidola, both of Milan, Italy

[73] Assignee: Diamond Shamrock Technologies S.A., Geneva, Switzerland

[21] Appl. No.: 774,103

[22] Filed: Mar. 7, 1977

Related U.S. Application Data

[63] Continuation-in-part of Ser. No. 672,279, Mar. 31, 1976, abandoned, and Ser. No. 673,460, Apr. 5, 1976, abandoned, and Ser. No. 681, 279, Apr. 28, 1976, abandoned and Ser. No. 686,943, May 17, 1976, abandoned.

[51] Int. Cl.[2] ..... C25B 1/34; C25B 11/00; C25C 1/00; C25C 7/00

[52] U.S. Cl. ..... 204/252; 204/67; 204/254; 204/268; 204/98; 204/290 R; 204/290 F

[58] Field of Search ..... 204/290 R, 290 F, 252, 204/254

[56] References Cited

U.S. PATENT DOCUMENTS

| | | | |
|---|---|---|---|
| 3,103,472 | 9/1963 | Slatin | 204/67 |
| 3,141,835 | 7/1964 | Rolin et al. | 204/67 X |
| 3,222,265 | 12/1965 | Beer | 204/290 F |
| 3,544,378 | 12/1970 | Broyde | 429/13 |
| 3,627,669 | 12/1971 | Entwisle et al. | 204/290 F |
| 3,663,280 | 5/1972 | Lee | 427/126 |
| 3,718,550 | 2/1973 | Klein | 204/67 |
| 3,846,273 | 11/1974 | Bianchi et al. | 204/290 F |
| 3,855,084 | 12/1974 | Feige | 204/38 R |
| 3,926,773 | 12/1975 | Koziol et al. | 204/290 F |

FOREIGN PATENT DOCUMENTS

| | | | |
|---|---|---|---|
| 1,221,380 | 7/1966 | Fed. Rep. of Germany | 204/284 |
| 2,150,039 | 4/1973 | Fed. Rep. of Germany | 204/290 F |
| 1,164,477 | 9/1969 | United Kingdom | 204/290 F |

*Primary Examiner*—F.C. Edmundson
*Attorney, Agent, or Firm*—Hammond & Littell

[57] ABSTRACT

Novel sintered electrodes comprised of a self-sustaining matrix of sintered powders of yttrium oxide and at least one electroconductive agent, the electrode being provided over at least a portion of its surface with at least electrocatalyst useful for electrolysis reaction and bipolar electrodes with the said matrix and electrolysis cells containing the said electrodes.

18 Claims, No Drawings

NOVEL YTTRIUM OXIDE ELECTRODES AND THEIR USES

PRIOR APPLICATION

This application is a continuation-in-part of our copending, commonly assigned application Ser. No. 672,279 filed Mar. 31, 1976, Ser. No. 673,460 filed Apr. 5, 1976, Ser. No. 681,279 filed Apr. 28, 1976 and Ser. No. 686,943 filed May 17, 1976 all now abandoned.

STATE OF THE ART

Dimensionally stable electrodes for anodic and cathodic reactions in electrolysis cells have recently become of general use in the electrochemical industry replacing the consumable electrodes of carbon, graphite and lead alloys. They are particularly useful in flowing mercury cathode cells and in diaphragm cells for the production of chlorine and caustic, in metal electrowinning cells wherein pure metal is recovered from aqueous chloride or sulfate solution as well as for the cathodic protection of ships' hulls and other metal structures.

Dimensionally stable electrodes generally comprise a valve metal base such as Ti, Ta, Zr, Hf, Nb and W, which under anodic polarization develop a corrosion-resistant but non-electrically conductive oxide layer or "barrier layer", coated over at least a portion of their outer surface with an electrically conductive and electrocatalytic layer of platinum group metal oxides or platinum group metals (see U.S. Pat. Nos. 3,711,385, 3,632,498 and 3,846,273. Electroconductive and electrocatalytic coatings made of or containing platinum group metals or platinum group metal oxides are, however, expensive and are eventually subjected to consumption or deactivation in certain electrolytic processes and, therefore, reactivation or recoating is necessary to reactivate exhausted electrodes.

Furthermore, electrodes of this type are not operable in a number of electrolytic processes. For example, in molten salt electrolytes, the valve metal support is rapidly dissolved, since the thin protection oxide layer is either not formed at all or is rapidly destroyed by the molten electrolyte with the consequent dissolution of the valve metal base and loss of the catalytic noble metal coating. Moreover, in several aqueous electrolytes, such as fluoride solutions or in sea-water, the breakdown voltage of the protective oxide layer on the exposed valve metal base is too low and the valve metal base is often corroded under anodic polarization.

Recently, other types of electrodes have been suggested to replace the rapidly consumed carbon anodes and carbon cathodes used up to now in severely corrosive applications such as the electrolysis of molten metal salts, typically for the electrolysis of molten fluoride baths such as those used to produce aluminum from molten cryolite. In this particular electrolytic process which is of great economic importance, carbon anodes are consumed at a rate of approximately 450 to 500 kg of carbon per ton of aluminum produced and expensive constant adjustment apparatus is needed to maintain a small and uniform gap between the corroding anode surfaces and the liquid aluminum cathode. It is estimated that over 6 million tons of carbon anodes are consumed in one year by aluminum producers. The carbon anodes are burned away according to the reaction:

$$Al_2O_3 + 3/2\ C \rightarrow 2Al + 3/2\ CO_2$$

but the actual consumption rate is much higher due to fragilization and breaking away of carbon particles and to intermittent sparking which takes place across anodic gas films which often form over areas of the anode surface since carbon is poorly wetted by the molten salts electrolytes, or to short circuiting caused by "bridges" of conductive particles coming from the corroding carbon anodes and from dispersed particles of the depositing metal.

British Pat. No. 1,295,117 discloses anodes for molten cryolite baths consisting of a sintered ceramic oxide material consisting substantially of $SnO_2$ with minor amounts of other metal oxides, namely, oxides of Fe, Sb, Cr, Nb, Zn, W, Zr, Ta in concentration of up to 20%. While electrically conducting sintered $SnO_2$ with minor additions of other metal oxides, such as oxides of Sb, Bi, Cu, U, Zn, Ta, As, etc., has been used for a long time as a durable electrode material in alterning current glass smelting furnaces (see U.S. Pat. Nos. 2,490,825, 2,490,826, 3,287,284 and 3,502,597), it shows considerable wear and corrosion when used as an anode material in the electrolysis of molten salts. We have found wear rates of up to 0.5 grams per hour per $cm^2$ from samples of the compositions described in the patents mentioned above when operated in fused cryolite electrolyte at 3000 $A/m^2$. The high wear rate of sintered $SnO_2$ electrodes is thought to be due to several factors: (a) chemical attack by the halogens, in fact $Sn^{IV}$ gives complexes of high coordination numbers with halogen ions; (b) reduction of $SnO_2$ by aluminum dispersed in the electrolyte; and (c) mechanical erosion by anodic gas evolution and salt precipitation within the pores of the material.

Japanese Patent Application No. 112589 (Publication No. 62,114 of 1975) discloses electrodes having a conductive support of titanium, nickel or copper or an alloy thereof, carbon graphite or other conductive material coated with a layer consisting substantially of spinel and/or perovskite type metal oxides and alternatively electrodes obtained by sintering mixtures of said oxides. Spinel oxides and perovskite oxides belong to a family of metal oxides which typically show good electronic conductivity and have been proposed previously as suitable electroconductive and electrocatalytic anodic coating materials for dimensionally stable valve metal anodes (see U.S. Pat. Nos. 3,711,382 and 3,711,297; Belgian Pat. No. 780,303).

Coatings of particulate spinels and/or perovskites have been found, however, to be mechanically weak as the bonding between the particulate ceramic coating and the metal or carbon substrate is inherently weak, because the crystal structure of the spinels and of the perovskites are not isomorphous with the oxides of the metal support and various binding agents such as oxides, carbides, nitrides and borides have been tried with little or no improvement. In molten salt electrolytes, the substrate material is rapidly attacked due to the inevitable pores through the spinel oxide coating and the coating is quickly spalled off the corroding substrate. Furthermore, spinels and perovskites are not chemically or electrochemically stable in molten halide salt electrolytes and show an appreciable wear rate due to halide ion attack and to the reducing action of dispersed metal.

In the electrolytic production of metals from molten halide salts, the mentioned anodes of the prior art have been found to have another disadvantage. The appreciable dissolution of the ceramic oxide material brings metal cations into the solution which deposit on the cathode together with the metal which is being produced and the impurity content in the recovered metal is so high that the metal can no longer be used for applications requiring electrolytic grade purity. In such cases, the economic advantages of the electrolytic process which are due, to a large extent, to the high purity attainable compared to the smelting processes are partially or entirely lost.

An electrode material to be used successfully in severly corrosive conditions such as in the electrolysis of molten halide salts and particularly of molten fluoride salts, should primarily be chemically and electrochemically stable at the operating conditions. It should also be catalytic with respect to the anodic evolution of oxygen and/or halides, so that the anode overpotential is lowest for high overall efficiency of the electrolysis process. The electrode should also have thermal stability at operating temperatures of, i.e., about 200° to 1100° C, good electrical conductivity and be sufficiently resistant to accidental contact with the molten metal cathode. Excluding coated metal electrodes, since hardly any metal substrate could resist the extremely corrosive conditions found in molten fluoride salt electrolysis, we have systematically tested the performances of a very large number of sintered substantially ceramic electrodes of different compositions.

THE INVENTION

It has now been found that highly efficient, insoluble electrodes are prepared by sintering yttrium oxide and at least one electroconductive agent into a self-sustaining body and providing on at least the surface thereof at least one electrocatalyst.

The sintered yttrium oxide electrodes of the invention are particularly useful in electrowinning processes used in the production of various metals such as aluminum, magnesium, sodium, potassium, calcium, lithium and other metals from molten salts. Yttrium oxide and at least one electroconductive agent, when used as an anode in direct current electrolysis of molten salt electrolytes, has been found to be unusually stable as an inert, dimensionally stable anode of sufficient electrical conductivity, and when provided on the surface thereof with oxide electrocatalysts such as $CO_3O_4$, $Ni_3O_4$, $MnO_2$, $Rh_2O_3$, $IrO_2$, $RuO_2$, $Ag_2O$, etc., has high electrocatalytic activity, particularly for chlorine evolution.

The term "sintered yttrium oxide" is meant to describe a self-sustaining, essentially rigid body consisting principally of yttrium oxide, and at least one electroconductive agent produced by any of the known methods used in the ceramic industry such as by the application of temperature and pressure to a powdered mixture of yttrium oxide and other materials to shape the mixture to the desired size and shape, or by casting the material in molds, by extrusion, or by the use of bonding agents and so forth, and then sintering the shaped body at high temperature into a self-sustaining electrode.

The electrical conductivity of the sintered ceramic electrodes are improved by adding to the composition 0.1 to 20% by weight of at least one electroconductive agent selected from the group consisting of (A) doping oxides, typically of metals having a valence which is lower or higher than the valence of the metals of the oxides constituting the matrix, such as the alkaline earth metal oxides of Ca, Mg, Sr and Ba and metals such as Zn, Cd, $In_2$, $Tl_2$, $As_2$, $Sb_2$, $Bi_2$ and Sn; (B) oxides showing electroconductivity due to intrinsic Redox systems such as spinel oxides, perovskites oxides etc.; (C) oxides showing electroconductivity due to metal to metal bonds such as $CrO_2$, $MnO_2$, TiO, $Ti_2O_3$ etc.; borides, silicides, carbides and sulfides of the valve metals such as Ti, Zr, Hf, V, Nb, Ta, Cr, Mo and W or the metals Y, Ti, Zr, Hf, V, Nb, Ta, Cr, Mo, W, Pd and Ag or alloys thereof or mixtures of (A) and/or (B) and/or (C).

By admixing with the powder of the matrix material, a minor amount, typically from 0.5 to about 30%, of powders of a suitable electrocatalytic material and by sintering the mixture into a self-sustaining body, it shows, when used as an electrode, satisfactory electroconductive and electrocatalytic properties which retains its chemical stability even though the admixed catalyst would not be resistant per se to the conditions of the electrolysis.

The catalyst may be a metal or an inorganic oxy-compound. The preferred admixed catalyst powders are the powdered metals Ru, Rh, Pd, Ir, Pt, Fe, Co, Ni, Cu and Ag, especially the platinum group metals; powdered oxy-compounds of Mn, Fe, Co, Ni, Ru, Rh, Pd, Ir, Pt, Ag, As, Sb and Bi and especially oxy-compounds of the platinum group metals.

Specifically preferred are $\beta MnO_2$, $Co_3O_4$, $Rh_2O_3$, $IrO_2$, $RuO_2$, $Ag_2O$, $Ag_2O_2$, $Ag_2O_3$, $As_2O_3$, $Sb_2O_3$, $Bi_2O_3$, $CoMn_2O_4$, $NiMn_2O_4$, $CoRh_2O_4$ and $NiCo_2O_4$ and mixtures of said powdered metals and oxy-compounds.

It has been found to be especially advantageous to add to the yttrium oxide a material such as stannous oxide, zirconium oxide or the like and that also by adding a small amount of at least one metal belonging to the group comprising yttrium, chromium, molybdenum, zirconium, tantalum, tungsten, cobalt, nickel, palladium and silver, both the mechanical properties and the electrical conductivity of the sintered yttrium oxide electrodes are improved without appreciably decreasing their chemical and electrochemical corrosion resistance.

These additives are added in powder form and mixed with the powdered yttrium oxide in percentages which may range from 40 to 1% calculated in terms of weight of the metal content. Optionally, yet other organic and/or inorganic compounds may be added to the powder mixture to improve on the bonding of the particles during both the moulding and sintering processes.

Anodes containing a major portion of $Y_2O_3$ have a high melting point well above the temperature of the molten salt electrolytes being used and they undergo no phase change under working conditions of the electrolysis. Moreover, the thermal elongation co-efficient is not far different from that of the halide salts used in the molten salts bath, which helps preserve the proper electrode spacing between the anode and the cathode and avoids expansions and contractions which might break the salt crust on the top of the molten salt electrolyte in the normal aluminum electrowinning process.

The conductivity of the sintered yttrium oxide electrodes of the invention is comparable with that of graphite. The matrix has acceptable work-ability in the forming and sintering operation and in use forms a thin layer of oxyhalides on its surface under anodic conditions. The yttrium oxide free formation energy is more negative than the oxide free formation energy of the corresponding halide-phase fused salt electrolyte, so that these sintered yttrium oxide anodes have a high degree of chemical stability.

The sintered yttrium oxide electrodes of the invention may also be used as bipolar electrodes. According to this latter embodiment, the sintered yttrium oxide electrodes may be conveniently produced in the form of a slab or plate whereby one of the two major surfaces of the electrode is provided with a layer containing the anodic electrocatalyst such as the oxides $CO_3O_4$, $Ni_3O_4$, $MnO_2$, $Rh_2O_3$, $IrO_2$, $RuO_2$, $Ag_2O$ etc. and the other major surface is provided with a layer containing suitable cathodic materials such as carbides, borides, nitrides, sulfides, carbonitrides etc. of metals, particularly of the valve metals and most preferably of yttrium, titanium and zirconium.

The self-sustaining sintered body consisting of a major portion of yttrium oxide may be prepared by grinding the materials together, or separately, preferably to a grain size between 50 and 500 microns, to provide a powder mixture which contains a range of grain sizes to obtain a better degree of compaction. According to one of the preferred methods, the mixture of powders is mixed with water or with an organic binding agent to obtain a plastic mass having suitable flowing properties for the particular forming process used. The material may be molded in known manner either by ramming or pressing the mixture in a mold or by slip-casting in a plaster of Paris mold or the material may be extruded through a die into various shapes.

The molded electrodes are then subjected to a drying process and heated at a temperature at which the desired bonding can take place, usually between 800 to 1800° C for a period of between 1 to 30 hours, normally followed by slow cooling to room temperature. The heat treatment is preferably carried out in an inert atmosphere or one that is slightly reducing, for example in $H_2 + N_2$ (80%), when the powdered mixture is composed essentially of yttrium oxide with a minor portion of other metal oxides or metals.

When the powdered mixture contains also metallic powders, it is preferable to carry out the heat treatment in an oxidizing atmosphere, at least for a portion of the heat treatment cycle to promote the oxidation of metallic particles in the outside layers of the electrodes. The metallic particles remaining inside the body of the sintered material improve the electrical conductivity properties of the electrode.

The forming process may be followed by the sintering process at a high temperature as mentioned above or the forming process and the sintering process may be simultaneous, that is, pressure and temperature may be applied simultaneously to the powder mixture, for example by means of electricaly-heated molds. Lead-in connectors may be fused into the ceramic electrodes during the molding and sintering process or attached to the electrodes after sintering or molding. Other methods of shaping, compressing and sintering the yttrium oxide powder mixture may of course be used.

The electrocatalyst, usually applied to the electrode surface due to costs, should have a high stability, a low anodic overpotential for the wanted anodic reaction, and a high anodic overpotential for non-wanted reactions. In the case of chlorine evolution, oxides of cobalt, nickel, iridium, rhodium, ruthenium or mixed oxides thereof such as $RuO_2$ — $TiO_2$ etc. can be used, and in the case of fluoride containing electrolytes wherein oxygen evolution is the wanted anodic reaction, oxides of silver and manganese are preferable. Other oxides for use as electrocatalysts may be oxides of platinum, palladium and lead.

Poisons for the suppression of unwanted anodic reaction may be used, such as, for example, to suppress oxygen evolution from chloride electrolytes. Poisons which present a high oxygen overpotential should be used, suitable materials are the oxides of arsenic, antimony and bismuth. These oxides which are used in small percentages may be applied together with the electrocatalyst oxides in percentage of 1 to 10% of the electrocatalyst calculated in terms of the respective metals weight.

The application of the electrocatalyst, and optionally of the poisoning agent may be effected by any of known coating methods. Preferably the electrocatalyst, and optionally the poisoning agent, are applied to the sintered yttrium oxide electrodes as a solution of decomposible salts of the metals. The sintered yttrium oxide body is impregnated with the solution containing the appropriate metal salts and dried. Hence the electrode is heated in air or in otherwise oxygen containing atmosphere to convert the salts into the wanted oxides.

Usually the porosity of the sintered yttrium oxide body and the method used to impregnate the surface layers of the sintered body with the metal salts should provide for the penetration of the solution down to a depth of at least 1 to 5 millimeters, preferably 3 mm, inward from the surface of the electrode so that after the heat treatment the electrocatalysts are present in the pores of the sintered yttrium oxide body down to a certain depth inward from the surface of the electrodes.

Alternatively, by appropriate powder mixing techniques, preformed electrocatalyst oxides and optionally preformed poisoning oxides, may be ground into powder form and added to the powder mixture during the moulding of the electrodes in such a way that the external layers of the moulded electrodes are enriched with powders of the electrocatalyst oxides, and optionally of the poisoning oxides, during the forming process whereby after sintering the surface of the electrodes is already provided with the electrocatalyst.

The sintered yttrium oxide electrodes of the invention may be used as bipolar electrodes. According to this embodiment of the invention, the yttrium oxide electrodes may be provided over one surface with the anodic electrocatalyst, and optionally with the poisoning agent for the unwanted anodic reaction by one of the methods disclosed above while the other surface may be provided with a coating of suitable cathodic material. For example, the surface of the bipolar electrode which will function as a cathode during the process of electrolysis may be provided with a layer of metal carbides, borides, nitrides, sulfides and/or carbonitrides of yttrium, tantalum, titanium, zirconium etc.

One preferred method to apply a layer is by plasma-jet technique whereby powders of the selected materials are sprayed and adhere to the surface of the sintered yttrium oxide body with a flame under controlled atmosphere. Alternatively, the selected powdered material may be added during the forming process to the yttrium oxide powder mixture and thence be sintered together whereby the cathodic surface of the bipolar electrode is provided with a layer of the selected cathodic material.

The sintered yttrium oxide activated with suitable electrocatalyst can be used as a non-consumable electrode in the electrolysis of molten salts and for other processes in which an electric current is passed through an electrolyte for the purpose of decomposing the electrolyte, for carrying out oxidation and reductions of organic and inorganic compounds or to impress a cathodic potential to a metallic structure which has to be protected from corrosion, as well as for primary and secondary batteries containing molten salts such as aluminum halides — alkali metal halides. The electrodes of the invention may be polarized as anodes or as cathodes or may be utilized as bipolar electrodes, whereby one face or end of the electrode acts as anode and the opposite face or end of the electrode acts as cathode with respect to the electrolyte contacting each face of the electrode respectively, as is known in the art of electrolysis.

The electrolysis cell of the invention comprises a cell provided with at least one set of a spaced anode and cathode and a means for impressing an electrolysis current on the said cell, the said anode being a dimensionally stable, three component electrode as discussed above. The cell is preferably used for electrolysis of molten metal salts such as aluminum chloride.

In the following examples there are described several preferred embodiments to illustrate the invention. However, it should be understood that the invention is not intended to be limited to the specific embodiments. The percentages of the electrode components are calculated in percent by weight as free metal based on the total metal content of the composition.

EXAMPLE 1

About 250 g of a mixture of the matrix material and additive materials indicated in Table I were ground in a mixer for 20 minutes and the powder mixtures were poured into cylindrical plastic molds and pre-compressed manually with a steel cylinder press. Each mold was placed in an isostatic pressure chamber and the pressure was raised to about 1500 Kg/cm$^2$ in 5 minutes and then reduced to zero in a few seconds. The samples were then taken out of the plastic molds and polished. The pressed samples were put into an electrically heated furnace and heated from room temperature to 1200° C under a nitrogen atmosphere over a period of 24 hours, held at the maximum temperature for 2 to 5 hours and then cooled to 300° C over the following 24 hours. The sintered samples were then taken out of the furnace and after cooling to room temperature, they were weighed and their apparent density and electrical conductivity at 25° and at 1000° C were measured. The results are reported in Table I.

TABLE I

| Sample No. | Composition % by weight | | Sintering time at max. temp. (hrs) | Apparent density g/cm$^3$ | Electrical conductivity at 1000° C $\Omega^{-1}$ cm$^{-1}$ | Electrical conductivity at 250° C $\Omega^{-}$ cm$^{-1}$ |
|---|---|---|---|---|---|---|
| A | $Y_2O_3$ | 75 | 5 | 5.2 | | |
| | $Ti_2O_3$ | 25 | | | 0.001 | — |
| | $Y_2O_3$ | 65 | | | | |
| 1 | $Ti_2O_3$ | 15 | 5 | 5.2 | 0.2 | — |
| | $Rh_2O_3$ | 20 | | | | |
| | $ZnO_2$ | 30 | | | | |
| | $Y_2O_3$ | 30 | | | | |
| 2 | WO | 10 | 5 | 5.5 | 0.4 | — |
| | $Ag_2O$ | 10 | | | | |
| | $RuO_2$ | 10 | | | | |
| | ZnO | 10 | | | | |
| | $Y_2O_3$ | 50 | | | | |
| | YOF | 15 | | | | |
| 3 | Y | 15 | 2 | 5.9 | 11 | 2.5 |
| | $IrO_2$ | 10 | | | | |
| | $Ag_2O$ | 10 | | | | |
| | $Y_2O_3$ | 60 | | | | |
| | $NiCo_2O_4$ | 20 | | | | |
| 4 | CdO | 5 | 2 | 5.7 | 7 | 0.2 |
| | CaO | 1 | | | | |
| | $Rh_2O_3$ | 19 | | | | |

The data in Table I shows that the electrical conductivity of the sintered ceramic electrodes at high temperatures of 1000° C is 5 to 10 times higher than the electrical conductivity at 25° C. The addition of oxides having conductivity equivalent to metals to the substantially non-conductive ceramic oxides of the matrix increases the conductivity of the electrodes by a magnitude of $10^2$ as can be seen from electrodes A and No. 1. The addition of a metal stable to molten salts such as yttrium or molybdenum, etc. to the ceramic electrodes of the invention increases the electrical conductivity of the electrodes by 2 to 5 times.

EXAMPLE 2

The conditions of operation of an electrolytic cell for the production of aluminum metal from a molten cryolite bath were simulated in a laboratory test cell. In a heated crucible of graphite, a layer of liquid aluminum was provided on the bottom and a melt consisting of cryolite (80 to 85%), alumina (5 to 10%) and $AlF_3$ (from 1 to 5%) was poured on top thereof. The sample electrodes with a working surface area of 3 cm$^2$ prepared according to the procedure described in Example 1 and to which a Pt wire was brazed to provide an easy means for electrical connection were dipped into the salt melt and held at a distance of about 1 cm from the liquid aluminum layer. The crucible was maintained at a temperature ranging from 950° to 1050° C and the current density was 0.5 A/cm$^2$ and the cell was operated for 2000 hours. The experimental data obtained is shown in Table II. The sample number indicates that the electrode tested corresponds to the sample described in Table I with the same number.

TABLE II

| Sample No. | Aluminum produced (g/h) | Weight loss of anodes (gr/cm$^2$) |
|---|---|---|
| 1 | 0.48 | 0.1 |
| 2 | 0.50 | 0.02 |

The test sample electrodes operated successfully as anodes in the cryolite melt and the observed wear rates appear to be quite acceptable for the electrolytic production of aluminum from molten cryolite. Both tested electrodes showed a low wear rate during 2000 hours of operation. In general, the wear rate of the electrodes containing thermal stabilizers such as oxy-compounds of metals of group III of the Periodic Table is about 10 times less than the electrodes without thermal stabilizers.

EXAMPLE 3

Electrode No. 1 described in Table I was used as an anode for the electrolysis of a molten aluminum chloride electrolyte in the test cell described in Example 2. The electrolysis conditions were the following:

| | | |
|---|---|---|
| Electrolyte | $AlCl_3$ | from 31 to 35% b.w.t. |
| | NaCl | from 31 to 35% b.w.t. |
| | $BaCO_3$ | from 31 to 35% b.w.t. |
| Temperature of Electrolyte | | from 690 to 720° C |
| Anodic current density | | 2000 Amp/m$^2$ |
| Cathode | Molten Aluminum | |
| Interelectrodic gap | 1 cm. | |

The tested electrode operated successfully and the weight loss after 2000 hours of operation was negligible.

EXAMPLE 4

Sintered anodes comprised of 70% by weight of $Y_2O_3$ and 30% by weight of $ZnO_2$ measuring 10 × 10 × 10 mm were impregnated with an aqueous solution of the chloride salt of the metals of Table III and were then heated in air at 300° to 650° C. The process was repeated until the amount of metal catalyst was 10 g/m$^2$ calculated as metal. The electrodes were then used as anodes in the electrolysis of a 5:1 mixture of $AlCl_3$—NaCl at a current density of 1000 A/m$^2$ at 750° C. The initial anode potential and the potential and the wear rate after 100 hours were determined. The results are in Table III.

TABLE III

| Electrocatalyst | Anode Potential V(RCGE) initial | Anode Potential V(RCGE) after 100 hrs | Wear rate g/m$^2$ after 100 hrs. |
|---|---|---|---|
| $Rh_2O_3$ | 0.2 | 0.2 | none detectable |
| $IrO_2$ | 0.0 | 0.0 | " |
| $Co_3O_4$ | 0.0 | 0.0 | " |

The electrodes showed excellent characteristics in the electrolysis of molten aluminum chloride.

EXAMPLE 5

Sintered anode coupons 10 × 10 × 10 mm consisting of 70% by weight of $Y_2O_3$ and 30% by weight of $ZrO_2$ were impregnated with the metals of Table IV with the process of Example IV. The anodes were used for the electrolysis of molten metal carbonate-fluoride salt and the wear rate anode potentials were determined as in Example 4. The results are reported in Table IV.

TABLE IV

| Electrocatalyst | Anode Potential V(RCGE) initial | Anode Potential V(RCGE) after 100 hrs | Wear rate g/m$^2$ after 100 hrs |
|---|---|---|---|
| $Ag_2O_x$ X>1 | 0.0 | 0.0 | nil |
| $IrO_2$ | 0.1 | 0.2 | " |
| $MnO_2$ | 0.2 | 0.2 | " |

The anodes operated successfully for the electrolysis of molten carbonate-fluoride salts in which oxygen was evolved at the anode.

EXAMPLE 6

Electrode sample No. 4 of Example 1 was used alternatively as anode and as cathode in the electrolysis of synthetic sea-water in a test cell in which the electrolyte was pumped through the electrodic gap of 3 mm at a speed of 3 cm/sec. The current density was maintained at 1500 A/m$^2$ and the spent electrolyte contained 0.8 to 2.4 of sodium hypochlorate with a faraday efficiency of more than 88%. The weight loss of the electrode after 200 hours at operation was negligible.

EXAMPLE 7

Electrode sample No. 3 of Example 1 was used as an anode in the electrolysis of an aqueous acidic cupric sulfate solution in a cell with a titanium cathode blank. The electrolyte contained 150 to 200 gpl of sulfuric acid and 40 gpl of cupric sulfate as metallic copper and the anode current density was 300 A/cm$^2$. The electrolyte temperature was 60° to 80° C and an average of 6 mm of copper was deposited on the flat cathode at a faraday efficiency ranging from 92 to 98%. The quality of the metal deposit was good and free of dendrites and the anode overvoltage was very low, ranging from 1.81 to 1.95 V(NHE).

EXAMPLE 8

One block of sintered $Y_2O_3$: $SnO_2$:Y metal in the ratios of 7:2:1 by weight of free metals, one block of sintered $Y_2O_3$:$ZrO_2$:Zr metal in the ratios of 6:3:1 by weight of free metals; and one block of sintered $Y_2O_3$:Pd metal in the ratios of 9:1 by weight of free metals were activated by impregnating the sintered samples with an aqueous solution of $CO\ Cl_3$ followed by drying and heating in air at 300° to 650° C to convert the chloride into $CO_3O_4$. The cycle was repeated to obtain a final coating of the electrodes of 15 g/m$^2$ of $Co_3O_4$ of anode surface. The activated anodes were used for the electrolysis of molten $AlCl_3$ + NaCl electrolyte and the anode potential and the wear rates are reported in Table V.

TABLE V

| Sample | Anode Potential V (S.C.G.E.) Initial | Anode Potential V (S.C.G.E.) After 100 hrs. | Wear Rates g/m$^2$ after 100 Hrs |
|---|---|---|---|
| $Y_2O_3$-$SnO_2$- Y | 0.1 | 0.1 | Nil |
| $Y_2O_3$-$ZrO_2$- Zr | 0.1 | 0.1 | Nil |
| $Y_2O_3$-Pd | 0.0 | 0.0 | 0.5 |

EXAMPLE 9

One block of sintered $Y_2O_3$. $ZrO_2$ and Pd metal in the weight ratio of 7:2.5:0.5 of free metals was impregnated over one of its larger surfaces with 15 g/m$^2$ of surface of $Co_3O_4$ by the method of Example 8. The opposite larger surface was coated with a layer 1 millimeter thick of zirconium di-boride applied by flame spraying under nitrogen atmosphere. The block was placed between two counter electrodes of graphite in electrical conducting relationship and spaced from the same. The interelectrodic spaces were filled with molten $AlCl_3$ + NaCl and the graphite counter electrode facing the zirconium di-boride coated surface of the sintered bipolar electrode was connected to the positive pole of the direct current supply and the graphite counter electrode facing the $Co_3O_4$ activated surface of the sintered bipolar electrode was connected to the negative pole of the D.C. supply. The sintered electrode operated as a bipolar electrode and molten aluminum metal flowed down the zirconium di-boride coated surface and was recovered at the bottom of the same while chlorine was evolved on the $Co_3O_4$ activated surface of the electrode. The electrolysis process was conducted satisfactorily for a period of 28 hours when the test cell fabricated mainly with graphite failed. The bipolar electrode after this period of operation did not show signs of deterioration and no wear was detected.

Other electrocatalysts which may be used in the electrolysis of molten halide salts for halide ion discharge are $RuO_2$, and oxides such as $As_2O_3$, $Sn_2O_3$ and $Bi_2O_3$ may be added in percentages up to 10% by weight of free metal based upon the total metal content to rise the oxygen overpotential without affecting the halide ion discharge potential.

For anodes to be used in molten fluoride electrolytes where oxygen is evolved, the catalyst may be those listed in Example V or $Rh_2O_3$, $PbO_2$ and $IrO_2.TiO_2$.

The compounds of the anodes given in the examples are calculated in percent by weight of free metal based upon the total metal content of the anode composition.

The electrolyte may contain other salts than those used in the Examples such as alkali metal chloride or fluoride as well as the salt of the metal undergoing electrolysis. The metal halides are effective to reduce the melting point of the salt undergoing electrolysis thus permitting use of lower temperatures while maintaining the salt bath in molten or melted state.

The above examples include fused or molten metal salt electrolysis, primarily the electrolysis of molten aluminum chloride or fluoride salts. In a similar manner, the molten chlorides of other metals such as alkali metal or alkaline earth metals may be electrolyzed using the designated anodes, according to otherwise standard practice. In addition, other molten salts, such as the molten nitrates, may be electrolyzed in the same way. A molten alumina-cryolite electrolyte or the like alkali metal aluminum fluoride may be electrolyzed to produced molten aluminum.

These electrodes may be used in place of graphite anodes in standard aluminum electrowinning cells with either aluminum ore feed into a cryolite bath or with aluminum chloride feed into a predominately aluminum chloride bath.

The use of these sintered yttrium oxide anodes for the recovery of the desired metals from fused salts of the metals to be won results in reduced power consumption per unit weight of metal produced and in purer recovered metals. The electrodes are dimensionally stable in service and therefore do not require frequent interventions to restore the optimum distance from the cathode surface as it is necessary with the consumable anodes of the prior art.

The sintered yttrium oxide anodes of our invention may also be used in aqueous or non-aqueous solutions of electrolytes for the recovery of one or more constituents of the electrolytes.

Various modifications of the electrodes and processes of the invention may be made without departing from the spirit or scope of our invention and it is to be understood that the invention is intended to be limited only as defined in the appended claims.

We claim:

1. An electrode comprising a self-sustaining body of sintered powders of a major amount of yttrium oxide and at least one electroconductive agent being provided over at least a portion of its surface with at least one electrocatalyst.

2. An electrode of claim 1 wherein the electroconductive agent is a minor portion of the sintered electrode body and is an oxide of at least one metal selected from the group consisting of zirconium and tin.

3. An electrode of claim 1 wherein the electroconductive agent is a minor portion of the sintered electrode body and is at least one metal selected from the group consisting of yttrium, chromium, molybdenum, zirconium, tantalum, tungsten, cobalt, nickel, palladium and silver.

4. An electrode of claim 1 wherein the electrocatalyst is at least one member selected from the group consisting of oxides of cobalt, nickel, manganese, rhodium, iridium, ruthenium and silver.

5. An electrode of claim 4 wherein the electrocatalyst is formed in situ on said sintered electrode body from a solution of salts of said metals which are converted to oxides on said sintered electrode body.

6. An electrode of claim 4 in which the electrocatalyst is comprised of powdered oxides of said metals sintered into the outer layers of said electrode.

7. A bipolar electrode comprising a self-sustaining body of sintered powders of a major portion of yttrium oxide and at least one electroconductive agent, said electrode being provided over at least a portion of its anodic surface with at least one anodic electrocatalyst and over at least a portion of its cathodic surface with a layer of cathodic material selected from the group consisting of metal carbides, borides, nitrides, sulfides and carbonitrides and mixtures thereof.

8. An electrode of claim 7 wherein the electroconductive agent is a minor portion of the sintered electrode body and is an oxide of at least one metal selected from the group consisting of zirconium and tin.

9. An electrode of claim 7 wherein the electroconductive agent is a minor portion of the sintered electrode body and is at least one metal selected from the group consisting of yttrium, chromium, molybdenum, zirconium, tantalum, tungsten, cobalt, nickel, palladium and silver.

10. An electrode of claim 7 wherein the electrocatalyst is selected from the group consisting of oxides of cobalt, nickel, manganese, rhodium, iridium, ruthenium, silver and mixtures thereof.

11. An electrode of claim 7 wherein the electrocatalyst is formed in situ on said sintered electrode body from a solution of salts of said metals which are converted to oxides on said sintered electrode body.

12. An electrode of claim 7 in which the electrocatalyst is comprised of powdered oxides of said metals sintered into the outer layers of said electrode.

13. A bipolar electrode of claim 7 wherein the layer of the said cathodic material is applied by flame spraying.

14. A bipolar electrode of claim 7 wherein the layer of the said cathodic material comprises powders of said cathodic material sintered into the outer cathodic surfaces of said electrode.

15. A bipolar electrode of claim 7 wherein the cathodic material is selected from the group comprising carbides, borides, nitrides, sulfides an carbonitrides of at least one metal selected from the group comprising yttrium, titanium and zirconium.

16. In an electrolytic cell comprising at least one anode and at least one cathode and means for imposing an electric potential between the said anode and cathode, the improvement wherein the anode is an electrode of claim 1.

17. An electrode for electrochemical reactions comprising a self-sustaining body of sintered powders with the major portion being comprised of yttrium oxide, said electrode being provided over at least a portion of its surface with at least one electrocatalyst selected from the group consisting of oxides of cobalt, nickel, rhodium, iridium, ruthenium, silver, manganese, and mixtures thereof.

18. The electrode of claim 17 in which the sintered self-sustaining body contains an oxide from the group consisting of zirconium dioxide and stannous oxide and mixtures thereof.

* * * * *